United States Patent [19]

Broms et al.

[11] Patent Number: 4,726,569

[45] Date of Patent: Feb. 23, 1988

[54] PREPARATION OF TUNDISHES

[75] Inventors: Gunnar Broms; Pär Lindahl, both of Stockholm, Sweden

[73] Assignee: AML Arbetsmiljolaboratoriet, Stockholm, Sweden

[21] Appl. No.: 648,374

[22] Filed: Sep. 7, 1984

[30] Foreign Application Priority Data

Sep. 13, 1983 [SE] Sweden ..... 8304897

[51] Int. Cl.[4] ..... C21C 5/44

[52] U.S. Cl. ..... 266/281; 266/286

[58] Field of Search ..... 266/280, 281, 286; 222/591; 264/30; 52/749

[56] References Cited

U.S. PATENT DOCUMENTS

| | | | |
|---|---|---|---|
| 3,236,397 | 2/1966 | Lakin | 264/30 |
| 3,438,171 | 4/1969 | Demarest | 52/749 |
| 3,735,546 | 5/1973 | Newman | 52/749 |
| 3,757,484 | 9/1978 | Williamson et al. | 52/749 |
| 4,218,050 | 8/1980 | Egli et al. | 264/30 |
| 4,226,563 | 10/1980 | Horikawa et al. | 52/749 |

FOREIGN PATENT DOCUMENTS

| | | | |
|---|---|---|---|
| 44975 | 12/1972 | Australia . | |
| 0008561 | 8/1979 | European Pat. Off. . | |
| 0064863 | 11/1982 | European Pat. Off. | 222/591 |
| 1422749 | 1/1976 | Fed. Rep. of Germany . | |
| 2061753 | 12/1976 | Fed. Rep. of Germany . | |
| 2414503 | 6/1982 | Fed. Rep. of Germany . | |
| 3123582 | 11/1982 | Fed. Rep. of Germany . | |
| 57-4374 | 1/1982 | Japan . | |
| 57-187163 | 6/1982 | Japan . | |
| 2028477 | 9/1982 | United Kingdom . | |

*Primary Examiner*—L. Dewayne Rutledge
*Assistant Examiner*—S. Kastler
*Attorney, Agent, or Firm*—Nixon & Vanderhye

[57] ABSTRACT

A method of preparing tundishes for use for continuously casting steel, whereby the cavity of the tundish is provided with a lining of performed slabs of refractory material in which the preparation is carried out using a preparation unit which comprises a lifting device supporting a manually moveable handling tool for the slabs, which transports them individually from a stack of slabs stored within reach of the handling tool and places them into their respective positions against the bottom, end or side walls of the inner cavity of a tundish using the necessary turning, tilting and movement in the vertical or horizontal plane for each slab during its transportation from the slab stack to its required position.

21 Claims, 6 Drawing Figures

PREPARATION OF TUNDISHES

The present invention concerns a method and apparatus for the preparation of tundishes for use in the continuous casting of steel, whereby the tundish is provided with an inner lining consisting of refractory slabs.

Generally, tundishes used in the continuous casting of steel have their metal walls protected by a permanent refractory lining, often made of bricks, this permanent lining may be provided with an inner expandable lining formed of a set of refractory slabs which in use is contacted by the molten metal and thus require periodic replacement. For this purpose, the tundish is transferred from the teeming platform to a tundish preparation station where first the residue of the previous inner lining is removed and the interior of the tundish is cleaned out. The preparation which follows has up to now been carried out manually without any mechanical aids. Thus the common practice of applying sand onto the bottom of the tundish and behind the new refractory slabs was done by manually carrying the sand in buckets. Similarly the operators carry the heavy lining slabs in order to fit them in the tundish carefully, on the bottom, at the ends and along the sides of the inner cavity of the tundish. This strenuous work is carried out completely manually. Placing and fitting of the slabs is carried out by an operator who maybe required to stand in the tundish. The tundish can often be very warm after casting, which causes additional operator discomfort during the preparation work or alternatively increases the tundish recycle time by requiring it to be cooled down to a more tolerable temperature which is clearly uneconomic for the steelmaker. The joints between the slabs are then filled with a refractory cement, by an operator using cement held in a bucket and a trowel. The operator may need to adopt a bent or kneeling position during the trowelling process. In general, then, it can be seen that the work is manual and physically very demanding and must be carried out in a difficult working environment. Due to the execution of this work, the preparation of a tundish is relatively time consuming.

The object of the present invention is to eliminate the health risks, which are associated with the very demanding physical aspects of the work and with the dust associated with the handling of the sand, and to ensure that the three main work components—sand filling, positioning of the lining slabs and cementing the joints between adjacent slabs with refractory cement—can be almost entirely carried out by one operator standing in a convenient position outside the tundish, and at the same time reduce the labour costs and the preparation time of each tundish. Further aims and benefits of the invention are given in the following description.

According to the present invention there is provided a method of preparing a tundish characterised by the use of a preparation unit which comprises a lifting unit and moveable handling tool for the slabs, which collects them individually with the aid of the handling tool from a slab stack situated within reach of the handling tool and places them in their respective positions against the bottom, ends and or sides of the inner cavity of a tundish using the necessary turning, angling, movement in the vertical or horizontal plane for each slab during its transportation from the slab stack to its respective position.

According to a further aspect of the present invention there is provided apparatus in the form of a preparation unit for use in lining a tundish with a set of preformed refractory slabs characterised in that it comprises a lifting unit having a moveable handling tool for the slabs, this handling tool comprising a gripping device for the slabs and is adapted to move, with the aid of the lifting unit, in the horizontal or vertical planes, the said gripping device is capable of rotating in the horizontal plane by means of bearings affixed to the lifting unit, and the gripping device is connected to the turning device by means of an arm which is arranged so as to be able to tilt the gripping device to the required angle.

As a result of this invention, the most important implements and aids for the preparation work can be assembled into one unit. The unit and its equipment can thereby be easily adapted to various steelwork's conditions without requiring extensive modification. Consequently the unit can be used for different, designs of tundishes. Furthermore, in addition to the above-mentioned tasks, the fitting of nozzles, casting tubes and stopper rod assemblies can also be carried out at the same location.

The invention is illustrated with reference to the drawings of the preparation unit in which.

Figure 1:
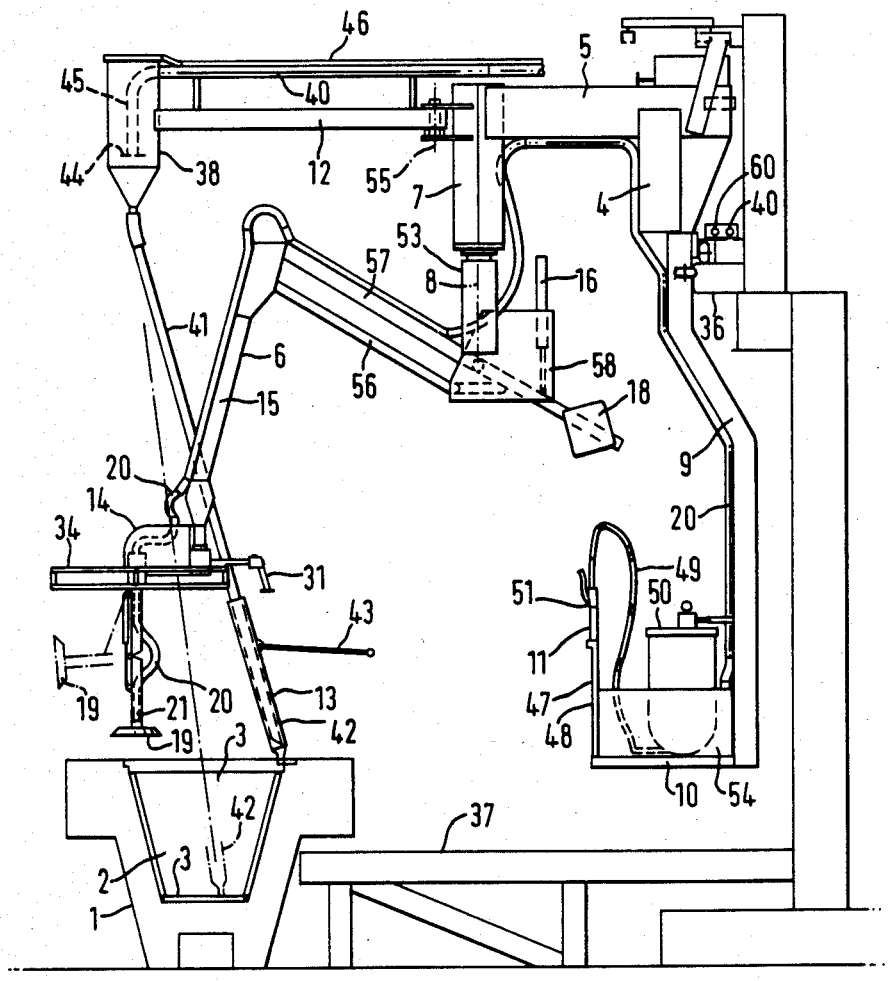
FIG. 1 is a schematic representation of a preparation station showing a preparation unit according to the invention.
Figure 2:
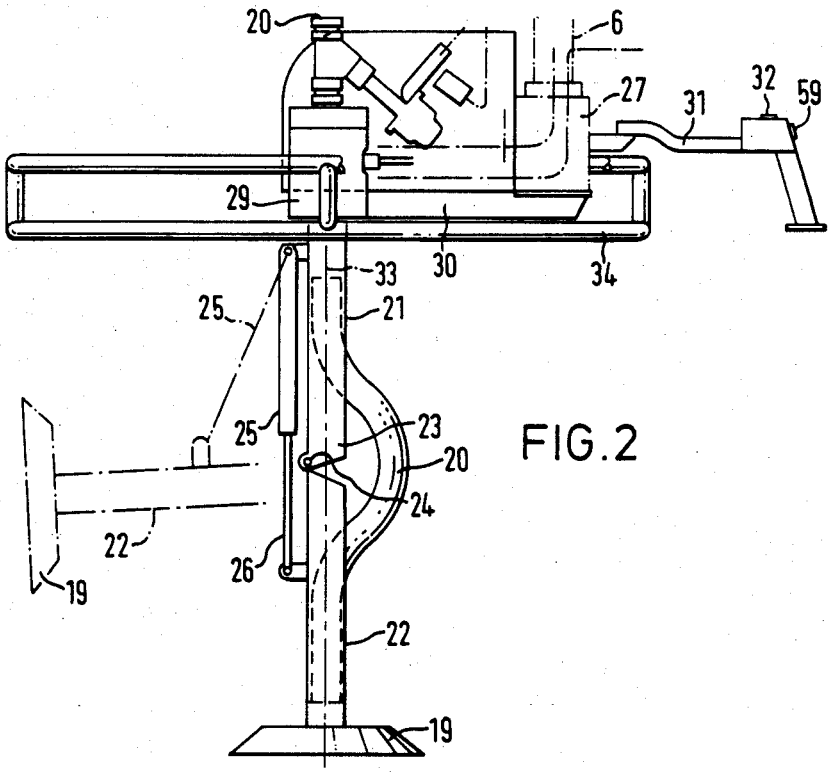
FIG. 2 shows a side view of the handling device of a preparation unit according to the invention.
Figure 3:
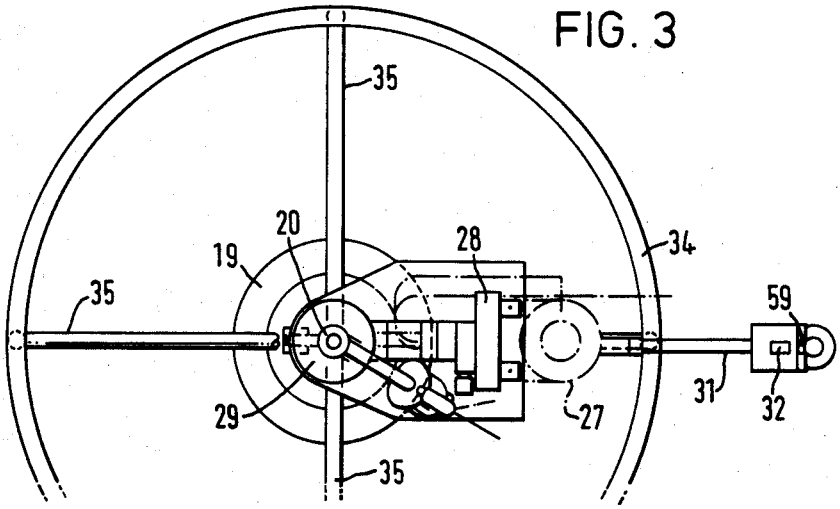
FIG. 3 shows a top view of the handling device shown in FIG. 2.

Referring to FIGS. 1 to 3 there is a tundish preparation station for the preparation of a tundish (1), having an inner cavity (2), whose ends, bottom and sloping side walls must be covered with a lining of preformed refractory slabs (3), which are to be transported from a nearby stack of slabs (not shown), this stack containing the correct number of slabs to line one tundish. The station is equipped with a preparation unit which comprises a supprt (4) and a travelling beam (5) which carries a lifting arm (6) via a central column (7), whereby the lifting arm (6) is mounted onto the central column via bearings which allow free rotation around a vertical axis (8) in a bearing unit (53). Furthermore the support (4) is equipped with a hanging arm (9) which carries a platform (10) with vacuum equipment (54) and with equipment (11) for applying the cement into the joints between the slabs. The support also carries a horizontal rotating arm (12) which is capable of rotating, in the same plane as the central column (7), around a vertical axis (55), and which in its turn at its free end carries equipment (13) for applying sand behind the slabs.

The lifting arm (6) carries, at its free end, a handling tool (14) for carrying the slabs (3) to the required position in the tundish from the nearby slab stack. The lift-arm consists of a lower boom (15) and a link system to two link arms (56, 57), which are flexibly jointed to the lower boom (15) and with the bearing unit (53) via the connecting unit (58). A hydraulic cylinder (16) is fitted onto the connecting unit (58) in order to work the link system so that the handling tool (14), via the travelling beam (5), can be raised or lowered in order that the installation can be affected at the required level. Furthermore the link system is so designed that the handling tool (14) can, at any level, be moved manually in the horizontal plane, during which operation the boom (15) can swing in and out due to the ratio of the link arms (56, 57). The link system has a counterweight (18), which serves to balance the waight of the handling tool. Since the lift arm is free to rotate around the vertical axis (8) in the bearing housing (53), the handling tool can therefore be moved manually in the horizontal plane to the right or left side depending upon the position of the operator with respect to the tundish. Furthermore the handling tool can be moved in the horizontal plane to any other place within reach of the lift arm. The lift arm has, therefore, a hydraulically driven movement up or down, and is manouvered manually in the horizontal plane.

The handling tool (14) is equipped with a gripping device in the form of a suction cup (19), which is connected via a flexible pipe (20) to the vacuum equipment (54) on the aforementioned platform (10). The suction cup is positioned on an arm (21), which consists of a lower portion which is capable of movement in the vertical plane or of setting at an angle (22), and an upper vertical portion (23), and the lower part is connected via a bearing to the upper part by means of a horizontal joint (24). A hydraulic cylinder (25) is fitted at one end to the upper arm (23) and with its piston rod end (26) fixed to the lower part of the arm (22). The gripping device, i.e. the suction cup (19), and the moveable arm are supported on a bracket (27), which in turn is mounted on the lift-arm (6). In order to make it work, a valve housing (28) and a combined hydraulic fluid reservoir and bearing housing (29) are also mounted on the bracket (27) by means of a connection piece (30). The bracket (27) also has a hand control (31) which rotates around its length in order to control the valves to the hydraulic cylinder (16) of the lift-arm (6). Movement of the lift-arm in the vertical plane is achieved by the operator smoothly opening or closing the hydraulic valve by twisting the hand control (31). Furthermore the hand control also has a switch (32) for switching the vacuum on or off to the suction cup (19) and a switch (59) for controlling the valve to the hydraulic cylinder (25) of the tilting arm (21). The suction cup (19) and arm (21) is also fitted via the reservoir/bearing housing (29) so that the upper arm can be rotated around its central axis (33). In addition to its other functions, the reservoir/bearing housing (29) contains a swivel coupling which contains channel connections to the hydraulic cylinder (25) of the arm (21), and to the vacuum pipe (20). In this way it is possible to carry out unlimited turning in either direction around the vertical axis (33) of the arm (21). In order to ease the turning of the arm (21) and the suction cup (19) a manouvering unit (34), which is ring shaped or like a steering wheel, is provided which is connected via rods (35) to the upper arm (23) immediately under the bearing housing (29), which therefore forms the hub of the manouvering unit. In the example shown, the manouvering unit consists of two circular rings. The manouvering unit (34) is given a sufficiently large diameter that the operator can work in a comfortable standing position even when lining the most distant side of the tundish with slabs.

The equipment for applying the sand (13) consists of a hopper (38) which is supported in the horizontal plane by the rotating arm (12). The sand is transported via a hose or tube system (40) from a central tank (not shown) which is held at a pressure of 1.5–3.0 atmospheres. The hopper is connected at the bottom part, which is conical, to a sand apparatus which comprises a tube (41) with a valve (not shown) for controlling the flow of the sand, which is gravity fed down through the tube. The tube (41) has a telescopic portion (42) connected to the bottom end, whereby the tube can be elongated such that the required reach can be achieved and the height of fall after the nozzle can be reduced to a minimum in order to reduce the dust when applying the sand. The telescopic portion of the tube (42) has a hand control lever (43) which is sufficiently long so that the operator can swing out the sand tube to the opposite side of the tundish and lengthen or shorten the sand tube whilst taking up a comfortable working position. The valve on the inner tube (41) for regulating the sand flow is controlled from the hand control unit (43). The telescopic tube portion (42) is suitably counterbalanced with, for example, a balance block in order to minimise the weight on the hand control unit (43). In order to prevent sand running out due to the pressure, the hopper (38) is equipped with a self regulating valve in the form of a baffle (44) which is fixed around the mouth of a central inlet pipe (45), which ends at a given distance vertically above the mouth of the hopper. This valve arrangement means that when the valve is opened in the sand tube the sand in the hopper runs down into the sand tube, and the inlet pipe (45) in the hopper is clear for a short time so that new sand is automatically forced out to fill the sand-free space around and above the baffle (44). When the cavity is filled, the back pressure of the sand effectively stops the flow. The transporting air from the hopper (38) is taken away via a tube (46) or directly through a filter, which means the system is dust-free.

The equipment (11) for applying the cement comprises a cement applicator (47) from which cement is continuously pumped via a tube (48) and a hose (49) which is connected to a pressure pot (50) placed on the platform (10). The pressure pot is supplied with compressed air from air-line (60) and is equipped with a stirrer to maintain an even consistency within the cement. The flow is regulated by a valve (51). The tube (48) can be designed such that the operator can apply the cement into the slab joints whilst standing in or outside the tundish.

In the example shown the preparation unit is mounted on crane tracks (36) via the central column (4) so that it can move along it, whereby a transporting system for the hose system (40) and the compressed air line (60) is fitted alongside the crane tracks. By this means the preparation unit can be moved to serve a number of tundishes (1), which are brought to the preparation station and placed next to each other. The preparation station also consists of a work platform (37), from which the operator can comfortably move about along the adjacent tundish or tundishes. The work platform is also built at such a height that the the operator can easily move out over the tundish.

The preparation unit described accordingly contains all the necessary equipment to carry out the three tasks, filling with sand, positioning the slabs and applying the refractory cement to the joints. The equipment gathered together into one unit is so designed that the operator can carry out most of the work standing outside the tundish, without the necessity of any heavy lifting. Because the equipment is assembled into one unit, this makes installation easier, and at the same time the unit can easily be adapted to differing steelplants designs and needs.

As well as the pressure pot (50) for the cement, the vacuum pump (54) for the suction cup (19) and the mounting equipment for the sand apparatus (13) and cementing apparatus (11), the material platform (10) can be supplied with or formed as a work bench which has space for the central vacuum pipe and materials such as bricks. tension bars and other tools which are needed during the preparation work. The control centre for the lift arm (6), vacuum pump (54) and the cement pump are suitably positioned on the platform (10).

The slabs (3) which can be either lying or standing on edge in the stack, are placed on or into the tundish within the reach of the lifting arm (6) and are fetched one by one with the aid of the lifting arm (6), whose suction cup (19) holds the slab (3) securely. By means of the manouvering ring (34) and the hydraulic cylinder (25) the slab can be turned and tilted limitlessly. Tilting between the horizontal and the vertical planes is done with the aid of the hydraulic cylinder (25), which is controlled from the same control unit (31) with the raising or lowering of the lift arm (6) is controlled. With the control ring (34) of the handling tool (14), the slabs can be rotated in their own plane. This arrangement means, for the operator, completely effort free handling of the slabs with optimum flexibility preserving manual control and precision in all positions. The ring (34) of handling tool (14) gives increased reach and also functions as protection for the operator from the working parts of materials it handles. With the aid of the sand equipment (13), manual precision filling with sand behind the slabs can take place. Since the tube is telescopic the free-fall height of the sand is reduced to a minimum, without affecting the shape or adjustability of the tube, which means that the dust is reduced. The dust free environment is also aided by the baffle arrangement (44) in the hopper (38) which gives a gentle and dust free flow of sand, since leakage and air surges in the return tube (46) are avoided. After the sand is filled into the bottom of the tundish and the refractory slabs are placed in position, the gaps between the slabs are sealed using the cementing apparatus, which is so formed that the operator can both apply and trowel out the cement in either the vertical or horizontal plane whilst standing outside the tundish. After this cementing, said is filled in behind the slabs as described earlier.

The handling tool can be mounted, preferably rigidly, in the same way as shown, with other types of lift arm then that shown and equipped with lifting gear of other types than suction cups.

The lift arm can be made mobile along a straight crane rail, as in the above described equipment, or a curved crane rail, or along a straight or curved traverse track, so that the same lift arm or preparation unit can serve two or more tundishes.

Figure 4:
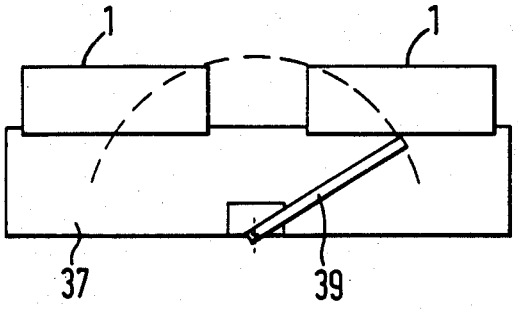
FIGS. 4 to 6 illustrate how one preparation unit according to the invention can be used for three different preparation stations, each serving a number of tundishes.
Figure 5:
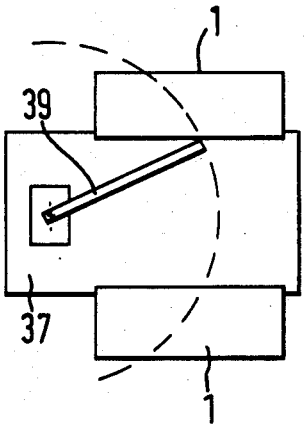
Figure 6:
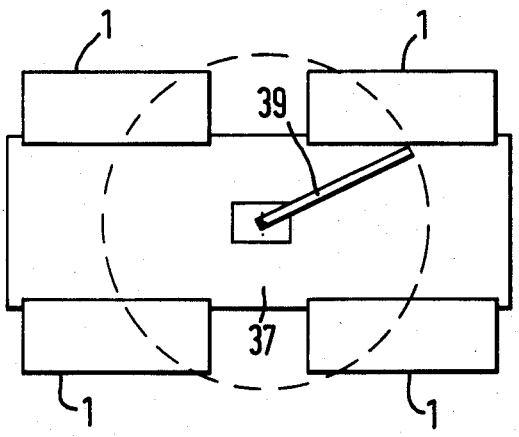

This aspect of the invention can be achieved with a stationary lift arm or preparation unit, which is more fully described and illustrated with reference to FIGS. 4 to 6, where the central column carries a swing arm (39) which is mounted on bearings and which has sufficient length so that it can be swung out to two tundishes placed on behind the other (FIG. 4), or two tundishes placed on each side (FIG. 5), or four tundishes which are placed on both sides of the platform (37) (FIG. 6). The lift arm and its uprights are fitted at the outermost end of the swing-arm (39).

The unit, or parts of it, can be used for other work besides preparation of tundishes. Therefore the invention embraces a general handling tool of the described and illustrated design for the handling of any flat items, which can be held by a suction cup and which are to be moved especially within a limited area, and positioned with precision with the necessary turning, tilting and movement in the horizontal plane. In this case the handling tool is suitably fitted with a lift-arm with a link-system of the described type. The invention further embraces equipment of the described type for dispensing particulate materials, including powders, i.e. not only sand, but other bulk materials, which are preferably dispensed manually for precision filling and which have tendency to give rise to a dust problem. There are, within the steel and foundry industries, a number of operations, besides the above-mentioned sand handling where the handling of bulk materials have up to now taken place manually with the associated weight problems, storage problems, wastage, spill and precision and dust problems which result. The above described equipment specifically for applying sand according to this invention considerably reduces these inconveniences and problems.

We claim:

1. Apparatus by lining the tundish with preformed slabs of refractory material, said apparatus comprising:
   - a lift arm;
   - a handling tool the handling tool including a gripping device for gripping
   - a bearing housing mounted to a free end of said lift arm;
   - means for mounting said gripping device to said bearing housing so that said gripping device is rotatable about a vertical axis with respect to said bearing housing;
   - said lift arm comprising means for moving said gripping device both horizontally and vertically in positioning slabs within a tundish; and
   - said means for mounting said gripping device to said bearing housing comprising an arm member mounted for pivotal movement about a horizontal axis.

2. Apparatus as recited in claim 1 wherein said arm member comprises a first arm member, and wherein said mounting means further comprises a second arm member pivotally connected to said first arm member, said second arm member operatively connected to said bearing housing and said first arm member being pivotal about said horizontal axis with respect to said second arm member and said housing; and wherein said gripping device is operatively rigidly connected to said first arm member.

3. Apparatus as recited in claim 2 further comprising a powered linear actuator operatively connected between said first and second arm members for effecting powered pivotal movement of said first and second arm members with respect to each other over a pivotal arc of approximately 90°.

4. Apparatus as recited in claim 3 wherein said linear actuator comprises a first component pivotally mounted to said first arm, and a second component pivotally mounted to said second arm, said first and second components slidely movable with respect to each other.

5. Apparatus as recited in claim 2 further comprising a control device operatively connected to said second arm member for effecting rotation thereof about said vertical axis.

6. Apparatus as recited in claim 5 wherein said control device comprises a ring of relatively large diameter, concentric with said vertical axis and connected to said second arm so that rotation of said ring effects rotation of said second arm about said vertical axis.

7. Apparatus as recited in claim 6 wherein said gripper device comprises a vacuum gripper having a vacuum pipe extending therethrough, and further comprising a swivel coupling contained within said bearing housing for connecting said vacuum pipe to a source of vacuum while allowing free rotation of said gripping device about said vertical axis.

8. Apparatus as recited in claim 1 further comprising means for mounting said lift arm for rotation about a vertical axis.

9. Apparatus as recited in claim 8 wherein said lift arm comprises first and second links of different length pivotally mounted for pivotal movement about a horizontal axis; and further comprising a powered linear actuator acting upon the longer of said links and effecting pivotal movement thereof about said horizontal axis.

10. Apparatus as recited in claim 1 further comprising means for effecting dust free application of sand onto the bottom of a tundish before positioning of the slabs on the bottom, and for applying sand in a gap behind the slabs when they are placed against end and side walls of a tundish cavity.

11. Apparatus as recited in claim 10 wherein said means for the application of sand comprises a tube operatively connected to a dispenser and having a telescopic portion at a free end thereof opposite the dispenser; a hand control lever operatively connected to said telescopic portion; means for mounting said tube for vertical and horizontal movement; and valve means for controlling the flow of sand through said tube.

12. Apparatus as recited in claim 11 wherein said dispenser comprises a hopper, and further comprising means for transporting sand under pressure to said hopper; and wherein said hopper has a central feed pipe having a mouth, and wherein said hopper has an outlet operatively connected to said tube; said mouth positioned a predetermined distance vertically above and in line with said outlet; and baffle means disposed in operative association with said mouth so that it is possible to tap off sand through the sand dispenser without the danger of a blowout.

13. Apparatus as recited in claim 1 further comprising means for applying refractory cement to the joints between slabs, said means comprising a cement applicator mounted for manual movement in operative association with said gripping device, said mounted in operative association with said dripping device, said cement applicator having valve means for controlling the passage of cement therethrough into the joints between slabs.

14. Apparatus for preparing a tundish for use for continuous casting of molten metal, by lining the tundish with preformed slabs of refractory material, said apparatus comprising:

a lift arm;

a handling tool for handling preformed slabs to be used in lining a tundish, the handling tool including a gripping device for gripping the slabs;

a bearing housing mounted to a free end of said lift arm;

means for mounting said gripping device to said bearing housing so that said gripping device is rotatable about a vertical axis with respect to said bearing housing;

said lift arm comprising means for moving said gripping device both horizontally and vertically in positioning slabs within a tundish; and a control device operatively connected to said gripping device for effecting rotation thereof about said vertical axis, said control device comprising a ring of relatively large diameter concentric with said vertical axis, and positioned so as to effectively increase the reach of the operator with the handling tool within the horizontal dimensions of a tundish.

15. Apparatus as recited in claim 14 wherein said gripper device comprises a vacuum gripper having a vacuum pipe extending therethrough; and further comprising a swivel coupling contained within said bearing housing for connecting said vacuum pipe to a source of vacuum while allowing free rotation of said gripping device about said vertical axis.

16. Apparatus for preparing a tundish for use for continuous casting of molten metal, by lining the tundish with preformed slabs of refractory material, said apparatus comprising:

a lift arm;

a handling tool for handling preformed slabs to be used in lining a tundish, the handling tool including a gripping device for gripping the slabs;

said handling tool operatively connected to said lift arm so that said lift arm comprises means for moving said gripping device both horizontally and vertically in positioning slabs within a tundish; and means for effecting dust free application of sand onto the bottom of a tundish before positioning of the slabs on the bottom, and for applying sand in a gap behind the slabs when they are placed against end and side walls of a tundish cavity.

17. Apparatus as recited in claim 16 wherein said means for the application of sand comprises a tube operatively connected to a dispenser and having a telescopic portion at a free end thereof opposite the dispenser; a hand control lever operatively connected to said telescopic portion; means for mounting said tube for vertical and horizontal movement; and valve means for controlling the flow of sand through said tube.

18. Apparatus as recited in claim 17 wherein said dispenser comprises a hopper, and further comprising means for transporting sand under pressure to said hopper; and wherein said hopper has a central feed pipe having a mouth, and wherein said hopper has an outlet operatively connected to said tube; said mouth positioned a predetermined distance vertically above and in line with said outlet; and baffle means disposed in operative association with said mouth so that it is possible to tap off sand through the sand dispenser without the danger of a blowout.

19. Apparatus as recited in claim 16 wherein said means for effecting dust free application of sand comprises a hopper and a tube extending from said hopper to a position adjacent a tundish; said hopper having a central feed pipe having a mouth, and having an outlet operatively connected to said tube; said mouth positioned a predetermined distance vertically above and in line with said outlet; and baffle means disposed in operative association with said mouth so that it is possible to tap off sand through the hopper without the danger of a blowout.

20. Apparatus as recited in claim 16 further comprising means for applying refractory cement to the joints between slabs, said means comprising a cement applicator mounted for manual movement to access all inner dimensions of a tundish which is mounted in operative association with said gripping device, said cement applicator having valve means for controlling the passage of cement therethrough into the joints between slabs.

21. Apparatus for preparing a tundish for use for continuous casting of molten metal, by lining the tundish with preformed slabs of refractory material, said apparatus comprising:

a lift arm;

a handling tool for handling preformed slabs to be used in lining a tundish, the handling tool including a gripping device for gripping the slabs;

said handling tool operatively connected to said lift arm so that said lift arm comprises means for moving said gripping device both horizontally and vertically in positioning slabs within a tundish; and means for applying refractory cement to the joints between slabs in a tundish, said means comprising a cement applicator for manual movement to access all inner dimensions of a tundish which is mounted in operative association with said gripping device, said cement applicator having valve means for controlling the passage of cement therethrough into the joints between slabs.

* * * * *